US006869918B2

(12) United States Patent
Cornelius

(10) Patent No.: US 6,869,918 B2
(45) Date of Patent: Mar. 22, 2005

(54) CLEANING BLADE LUBRICANT

(76) Inventor: Lester Cornelius, 37 Anstic St., Oyster Bay, NY (US) 11771

( * ) Notice: Subject to any disclaimer, the term of this patent is extended or adjusted under 35 U.S.C. 154(b) by 0 days.

(21) Appl. No.: 10/366,919

(22) Filed: Feb. 19, 2003

(65) Prior Publication Data

US 2003/0207770 A1 Nov. 6, 2003

Related U.S. Application Data

(60) Provisional application No. 60/376,937, filed on May 2, 2002.

(51) Int. Cl.[7] ..... C10M 147/00; C10M 149/10; G03G 21/00

(52) U.S. Cl. ..... 508/181; 508/268; 508/583; 399/346

(58) Field of Search ..... 508/181, 182, 508/183; 399/346

(56) References Cited

U.S. PATENT DOCUMENTS 4,012,551 A * 3/1977 Bogaty et al. ..... 428/192
4,279,500 A * 7/1981 Kondo et al. ..... 399/346
4,658,756 A * 4/1987 Ito et al. ..... 399/346
4,757,349 A * 7/1988 Toshimitsu et al. ..... 399/346
4,970,560 A * 11/1990 Lindblad et al. ..... 399/350
5,138,395 A * 8/1992 Lindblad et al. ..... 399/346
5,160,790 A * 11/1992 Elton ..... 428/412
5,609,082 A * 3/1997 Kuchta ..... 83/13
5,997,772 A * 12/1999 Cornelius et al. ..... 252/507
6,077,592 A * 6/2000 Azuma et al. ..... 428/192
6,253,052 B1 * 6/2001 Cornelius et al. ..... 399/274
6,455,476 B1 * 9/2002 Imai et al. ..... 508/156
6,521,386 B1 * 2/2003 Sakon et al. ..... 430/58.15

* cited by examiner

*Primary Examiner*—Ellen M McAvoy
(74) *Attorney, Agent, or Firm*—Charles E. Temko

(57) ABSTRACT

A lubricant for wiper blades used to remove residual toner particles from a photoconductive surface comprising a finely divided fluoropolymer and a binder resin typically polyvinylpyrollidinone, applied as a coating using an evaporable vehicle.

1 Claim, No Drawings

CLEANING BLADE LUBRICANT

RELATED APPLICATION

Reference is made to my copending provisional application Ser. No. 60/376,937 filed May 2, 2002, to which a claim of priority is made.

BACKGROUND OF THE INVENTION

Copiers and printers using the electrophotographic process contain photoconductors to create a latent image which is developed with toner. The toner on the photoconductor then transfers to paper which then travels through a fuser which fixes the toner on the paper. The transfer of toner from the photoconductor to the paper is not 100% efficient. The residual toner on the photoconductor must be removed. The toner is removed by an elastomeric blade, such as urethane rubber, which scrapes the surface of the photoconductor.

The friction between the cleaning blade and the photoconductor wears the surface of the photoconductor. Various lubricating powders have been used to reduce the friction between the photoconductor and the cleaning blade, such as zinc stearate and graphite fluoride applied to the photoconductor surface. These powders are also removed by the cleaning blade and thus have little effect on reducing the wear on the photoconductor surface. Powders can also migrate to other components in the electrophotographic system, such as contact charging rollers, and this can result in print defects.

Liquid dispersions of zinc stearates or graphite fluoride also have been applied to cleaning blades, which provide longer lasting lubrication, as described in U.S. Pat. No. 5,646,718.

SUMMARY OF THE INVENTION

Briefly stated, it is the purpose of the present invention to create a liquid lubricant which will dry to a film that provides long lasting lubrication. This coating contains a fluoropolymer in a binder resin which also lubricates the photoconductor surface.

DETAILED DESCRIPTION OF THE DISCLOSED EMBODIMENT

The solvent may be any solvent that is compatible with the polyvinylpyrollidinone and water. Its purpose is to improve the wetting of the coating. Ethanol, where used, also serves to prevent bacterial growth in the solution. This function can also be served by using surfactants and biocides that are compatible with the photoconductor. It is preferable to use a solvent that will evaporate and not present potential photoconductor compatibility problems. A flow and slip, or anti-blocking compound can be added to further reduce the friction between the optical photoconductor and the wiper blade. The following examples are illustrative. Percentages are by weight.

EXAMPLE 1

Aqueous

10% denatured ethanol
2.1% polyvinylpyrollidinone (Luviskol K90, BASF)
45.8% polytetrafluoroethylene (Fluoro AQ 50 dispersion, Shamrock Technologies, Inc. Newark N.J. or Dupont 307 A fluoropolymer dispersion)

0.50% BYK 341 (Byk Chemie, Wallinford, Conn.) (Flow and Slip composition)
41.60% deionized water The ingredients are mixed in a high shear mixer to obtain full dispersion.

EXAMPLE 2

Aqueous

10% denatured ethanol
2.1% polyvinylpyrollidinone (Luviskol K90)
22.9% polytetrafluorethylene powder (MP 1100, Dupont)
0.25% BYK 341 (Byk Chemie, Wallinford Conn.)
64.75% deionized water The ingredients are mixed in a high shear mixer until completely dispersed.

EXAMPLE 3

Solvent System 12.8% polytetrafluoroethylene (MP 1100) Dupont
1.2% polyvinylpyrollidinone (Luviskol K 90, BASF)
0.14% BYK 341 (Byk Chemie, Wallinford, Conn.)
85.86% denatured ethanol The ingredients are mixed in a high shear mixer for complete dispersion.

The coatings are applied to the wiper blades by any liquid coating application technique, such as dipping, spraying, flow coating, or brushing. The coating material tends to run away from the scraping edge of the blade which forms a right angle corner. It coats the flat surface of both sides of the scraping edge. Most of the optical photoconductor surface wear takes place 1.5 mm–3 mm past the scraping edge, and this is the area where the coating is most useful. The coating may be air dried, or dried using heat to accelerate the evaporation of the water and/or solvent.

There is thus provided a highly dispersed fluoropolymer resin with a binder resin that lubricates in a suitable liquid carrier such as a solvent, water, or combinations of solvent and water. In all of the above examples, the anti-blocking compound, or flow and slip compound is added to further reduce the friction between the optical photoconductor surface and that of the wiper blade. By placing the fluoropolymer resin in a binder resin, the life of the coating is significantly enhanced. Initial observations indicate that wear reduction of the optical photoconductor surface is as much as 60%, as compared with prior art lubricants.

I wish it to be understood that I do not consider the invention to be limited to the precise details described in the disclosure, for obvious modifications will occur to those skilled in the art to which the invention pertains.

I claim:

1. In a method for removing residual toner particles from a photoconductor surface of a photoelectrostatic reproductive device, the steps of:

a) providing a wiper blade for selective contact with said photoconductor surface; and b) applying a friction-reducing lubricant to contacting surfaces of said blade, said lubricant comprising a fluoropolymer, a binder resin forming a permanent coating carrying said fluoropolymer, and an evaporable liquid carrier forming means for applying said lubricant to said blade.

* * * * *